US006966420B2

(12) United States Patent
Ackmann et al.

(10) Patent No.: US 6,966,420 B2
(45) Date of Patent: Nov. 22, 2005

(54) DRIVE UNIT FOR ESCALATORS OR MOVING SIDEWALKS

(75) Inventors: Thorsten Ackmann, Auetal (DE); Dietmar Thaler, Seggebruch (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/311,703

(22) PCT Filed: Jun. 19, 2001

(86) PCT No.: PCT/US01/19528

§ 371 (c)(1),
(2), (4) Date: May 5, 2003

(87) PCT Pub. No.: WO02/02452

PCT Pub. Date: Jan. 10, 2002

(65) Prior Publication Data

US 2003/0205443 A1 Nov. 6, 2003

(30) Foreign Application Priority Data

Jun. 19, 2000 (DE) ..... 100 30 052

(51) Int. Cl.[7] ..... B66B 23/16

(52) U.S. Cl. ..... 198/330

(58) Field of Search ..... 198/321, 322, 198/330

(56) References Cited

U.S. PATENT DOCUMENTS

| | | | | |
|---|---|---|---|---|
| 3,677,388 | A * | 7/1972 | Boltrek et al. | 198/330 |
| 3,951,256 | A * | 4/1976 | Gurewitz | 198/831 |
| 4,775,044 | A | 10/1988 | Höfling | 198/330 |
| 5,224,580 | A * | 7/1993 | Nurnberg et al. | 198/330 |
| 6,155,401 | A | 12/2000 | Lunardi et al. | 198/330 |
| 6,273,235 | B1 | 8/2001 | Inoue | 198/330 |

* cited by examiner

*Primary Examiner*—James R. Bidwell

(57) ABSTRACT

A passenger conveyor (2) with a running belt (4) contains a frame (6). A main running belt drive (12) is mounted on the frame (6) and contains a drive shaft (10) and at least one running belt driving wheel that is connected to the drive shaft. A drive unit contains a driving motor (16) and a step-down gear (18). The output of the step-down gear (18) is connected to the input of the main running belt drive (12). The driving motor (16) is mounted on the housing (22) of the step-down gear (18), with the driving motor (16) and the step-down gear (18) forming a drive unit (8), and the drive unit (8) is supported by the main running belt drive (12).

24 Claims, 2 Drawing Sheets

DRIVE UNIT FOR ESCALATORS OR MOVING SIDEWALKS

The invention pertains to a passenger conveyor with a running belt, in particular, an escalator or a moving sidewalk, with said passenger conveyor consisting of a frame, a main running belt drive that is mounted on the frame and that contains a drive shaft and at least one running belt driving wheel that is connected to the drive shaft, and a drive unit for driving the main running belt drive which contains the driving motor and a step-down gear, with the output of the step-down gear being connected to the input of the main ruining belt drive.

BACKGROUND OF THE INVENTION

Numerous passenger conveyors of this type are currently in use. The running belt represents the passenger conveying element of the passenger conveyor. The passengers are transported along the exposed surface of the running belt while standing or walking. In an escalator, the running belt is also referred to as a step belt. The step belt consists of several steps that are connected to one another by means of a step chain. A main running belt drive is usually provided in one of the reversal regions of the running belt, with the main running belt drive typically containing two chain wheels for driving the running belt which engage into a step chain. The main running belt drive is driven by a drive unit.

In moving sidewalks, the running belt is formed by individual pallet bodies that are connected to one another. Consequently, the running belt is also referred to as a pallet belt in such instances. The pallet bodies are connected to one another with transport chains similar to escalators and driven by a main running belt drive. However, there also exist moving sidewalks, in which the running belt consists of a relatively elastic material, e.g., a reinforced plastic material, which essentially extends continuously along the length of the running belt, i.e., no individual steps or pallets are provided in this case. These moving sidewalks usually are also driven by a main running belt drive that is arranged in one of the reversal regions.

The drive unit for driving the main running belt drive frequently contains a driving motor, to which a first stage of a step-down gear is directly connected. The brake for the passenger conveyor is also frequently arranged within the region of the driving motor. The driving motor is usually mounted on the frame of the passenger conveyor together with the first stage of the step-down gear. The output of the first stage of the step-down gear drives the main running belt drive via a so-called intermediate gear. The intermediate gear usually consists of either a chain gear or a toothed wheel gear. Since the intermediate gear usually needs to cover a certain distance, this can be easily realized with a chain gear, i.e., the distance to be covered can be easily achieved with a slightly longer chain. Intermediate gears that are designed in the form of toothed wheel gears usually contain several intermediate wheels that have a uniform size and consequently are not required for the gear reduction. Chain gears are usually utilized in so-called department store systems, e.g., in department stores, malls, shopping arcades or even office buildings. So-called traffic systems as they are used in public traffic areas, e.g., railway stations, airports, subway stations, etc., need to fulfill significantly higher requirements than systems used in commercial applications. Intermediate gears that are realized in the form of toothed wheel gears are, in particular, utilized in traffic systems.

All known embodiments of these systems have several disadvantages. First, a series of individual components is required which need to be positioned relative to one another and separately mounted on the frame. The separate mounting of, in particular, the driving motor on the frame results in the additional introduction of vibrations into the frame and consequently an undesirable noise development. The separate mounting also has the disadvantage that the components need to be respectively adjusted relative to one another. This increases the assembly costs, i.e., the competitiveness is disadvantageously influenced. In addition, individual housings are respectively required for the individual components. This results in an additional material requirement and increases the costs.

SUMMARY OF THE INVENTION

Consequently, the present invention is based on the objective of designing a passenger conveyor of the initially described type in such a way that the introduction of vibrations from the driving motor into the frame is prevented, and that the passenger conveyor is designed such that it can be easily and inexpensively manufactured.

According to the invention, this objective is attained with a passenger conveyor which is characterized by the fact that the driving motor is mounted on the housing of the step-down gear, with the driving motor and the step-down gear forming a drive unit, and by the fact that the drive unit is supported by the main running belt drive. The brake is preferably also integrated into the drive unit. The brake may, for example, be arranged between the driving motor and the step-down gear in the form of a separate component or integrated into the driving motor or the step-down gear.

If this design is compared to constructions known from the state of the art, one can easily ascertain that only one gear that realizes the entire gear reduction is provided instead of two separate step-down gears. The driving motor is mounted on the housing of this gear. In this case, the brake may, if so required, be arranged between the step-down gear and the driving motor. Consequently, a direct mounting of the driving motor on the frame is no longer necessary, and the introduction of vibrations into the frame is significantly reduced. The step-down gear and the driving motor, as well as, if applicable, the brake, consequently form an integral drive unit. An additional characteristic feature can be seen in the fact that this integral drive unit is directly supported by the main running belt drive. The drive unit can be preassembled in its entirety in the form of only one component. Special adjustments of this drive unit are not required. The drive unit may, in particular, be designed such that the housing of the step-down gear simultaneously forms the end shield for the rotor of the driving motor. In this case, it is particularly advantageous if the housing of the step-down gear simultaneously forms the housing of the brake. Alternatively, the housing of the driving motor may be connected to the housing of the step-down gear by means of conventional connecting elements. During the assembly of the passenger conveyor, the entire drive unit can be mounted on the main running belt drive. Depending on the type of mounting, only a slight adjustment or no adjustment at all is required as described in greater detail below.

The drive unit is preferably supported by the shaft of the main running belt drive. The shaft of the main running belt drive may, for example, contain a longitudinal toothing that fits into a corresponding toothing on the output of the step-down gear. In this case, the drive unit is, in essence, merely pushed onto the drive shaft of the main running belt drive and secured from becoming loose, e.g., by means of a bolt connection or keying.

Alternatively, the housing of the drive unit may, for example, be connected to the support construction of the main running belt drive, e.g., rigidly bolted thereon. In this type of construction, a certain alignment is necessary in order to ensure a flawless power flux from the driving motor to the main running belt drive via the step-down gear. For example, if the step-down gear is not mounted on the main running belt drive in a correctly aligned fashion, misalignments between the rotating parts and consequently an increased wear may result. In contrast to instances, in which the drive unit is supported by the drive shaft of the main running belt drive, this type of construction requires certain adjustments.

A torque support is preferably provided between the frame of the passenger conveyor and the drive unit. The torque support may, for example, originate at the housing of the step-down gear or at the driving motor. The torque support is, in particular, required in constructions in which the drive unit is merely supported by the drive shaft of the main running belt drive. Due to the longer lever arms, this design is, however, also advantageous in constructions in which the drive unit is also connected to the main running belt drive, e.g., on its support frame. The torque support may be directly connected to the flame of the passenger conveyor. However, this connection may also be realized indirectly by means of components arranged in between. In extreme instances, the torque support may also be designed differently. It may, if so required, also be realized relative to the building in which the passenger conveyor is installed.

An elastic torque support is preferably provided. This torque support may, for example, consist of conventional shock absorbers or coil spring shock absorbers as they are used in large quantities, for example, in the automotive industry. Components of this type are particularly preferred with respect to cost considerations. Polymer vibration insulators or rubber insulators or insulators consisting of another suitable elastic material may also be considered for this purpose.

The step-down gear is preferably realized in the form of a toothed wheel gear. Toothed wheel gears generally are better suited for transmitting high loads. In addition, they require less maintenance. This is particularly advantageous with respect to the integrated construction of the drive unit. A step-down gear with three stages is particularly preferred. The most suitable step-down gear consists of a step-down gear with three stages, in which the first stage consists of a conical gear that serves for turning the axis of rotation by 90, with the second stage and the third stage of the step-down gear consisting of spur gears, in which the direction of the axis of rotation remains unchanged, i.e., the axis of rotation is merely shifted in a parallel fashion from stage to stage.

The required gear reduction ratios can be realized in a particularly advantageous fashion with step-down gears that contain three stages. The typical rotational speed of a conventional driving motor, e.g., a four-pole asynchronous motor, lies at approximately 1500 rpm at a supply frequency of 50 Hz. At the same frequency, six-pole asynchronous motors have a rotational speed of approximately 1000 rpm. Since rotational speeds on the order of approximately 10 rpm are desirable for driving the main running belt drive, it would be necessary to achieve a gear reduction ratio of approximately 120:1. A particularly preferred step-down gear contains a conical gear with a gear reduction ratio of approximately 6:1 as the first stage, a first gear reduction stage with a spur gear that has a gear reduction ratio of approximately 4:1, and a second gear reduction stage with a spur gear that has a gear reduction ratio of approximately 6:1. This results in a total gear reduction ratio of about 120:1. The conical gear may advantageously consist of a hypoid bevel gear or any other type of conical gear.

Alternatively, the step-down gear may also consist of a chain gear or a combination of a toothed wheel gear and a chain gear.

The housing of the step-down gear is preferably divided into different chambers in order to allow the use of different lubricants for the different gear stages. It is quite obvious that fast gears require a lubrication of higher quality than slow gears. Analogously, gears with a high power density require a correspondingly superior lubrication. For example, grease lubrication frequently suffices for slow gears, with faster gears advantageously being provided with oil lubrication. If a common lubrication for all gear stages is provided, the gear stage with the highest requirements defines the quality of the lubricant and the lubricant change intervals. If the step-down gear is divided into different chambers, it is possible to select a suitable lubricant for each individual chamber. Due to this measure, the required quantity of expensive, high-quality lubricant can be significantly reduced. The lubricant change intervals of both chambers can be adapted to one another in such a way that essentially no additional maintenance expenditure results by suitably selecting the size of the chambers and adapting the respective lubricants to one another.

It is preferred that a first chamber be provided for the first and the second gear stage, with a second chamber being provided for the third stage.

Individual modules that respectively contain the first stages of the step-down gear and a driving motor preferably can be connected to the last toothed wheel of the gear train, from which the output of the step-down gear takes place. This can be realized in a particularly simple fashion if a first chamber is provided for the first and the second gear stage and a second chamber is provided for the third stage. The option of being able to connect several individual modules with a driving motor and the first stages of the step-down gear to the last toothed wheel of the gear train males it possible to realize drive units for passenger conveyors of any size with only a few identical components, namely in accordance with a modular concept. It is quite obvious that passenger conveyors with short conveying lengths or small conveying heights require a significantly lower driving power than passenger conveyors with long conveying lengths or large conveying heights. Until now, driving motors of different power ratings were used for different power requirements. Separate gear sizes were manufactured for each power rating of driving motors. The production and storage of these components was correspondingly cost-intensive. The proposed modular design according to the invention makes it possible to realize drive units for any power rating of passenger conveyors with merely two different components, i.e., the last toothed wheel of the gear train in a housing with several connecting options and the module with the first stages of the step-down gear and a driving motor.

The drive of the step-down gear is preferably connected to the shaft of the main running belt drive.

The last toothed wheel of the gear train preferably is directly connected to the running belt driving wheel of the main running belt drive. This embodiment provides the advantage that, in extreme instances, the last toothed wheel of the gear train and the running belt driving wheel of the main running belt drive can be realized integrally. Since both components frequently have essentially the same diameter, the manufacture can be simplified in many instances with this measure.

The invention also pertains to a drive unit for a passenger conveyor with running belt according to the invention which contains a driving motor and a step-down gear that is connected to the main running belt drive, with said drive unit being characterized by the fact that the driving motor is mounted on the step-down gear.

BRIEF DESCRIPTION OF THE DRAWINGS

The invention is described in greater detail below with reference to one embodiment that is illustrated in the figures. The figures show.

DESCRIPTION OF THE PREFERRED EMBODIMENT

Figure 1:
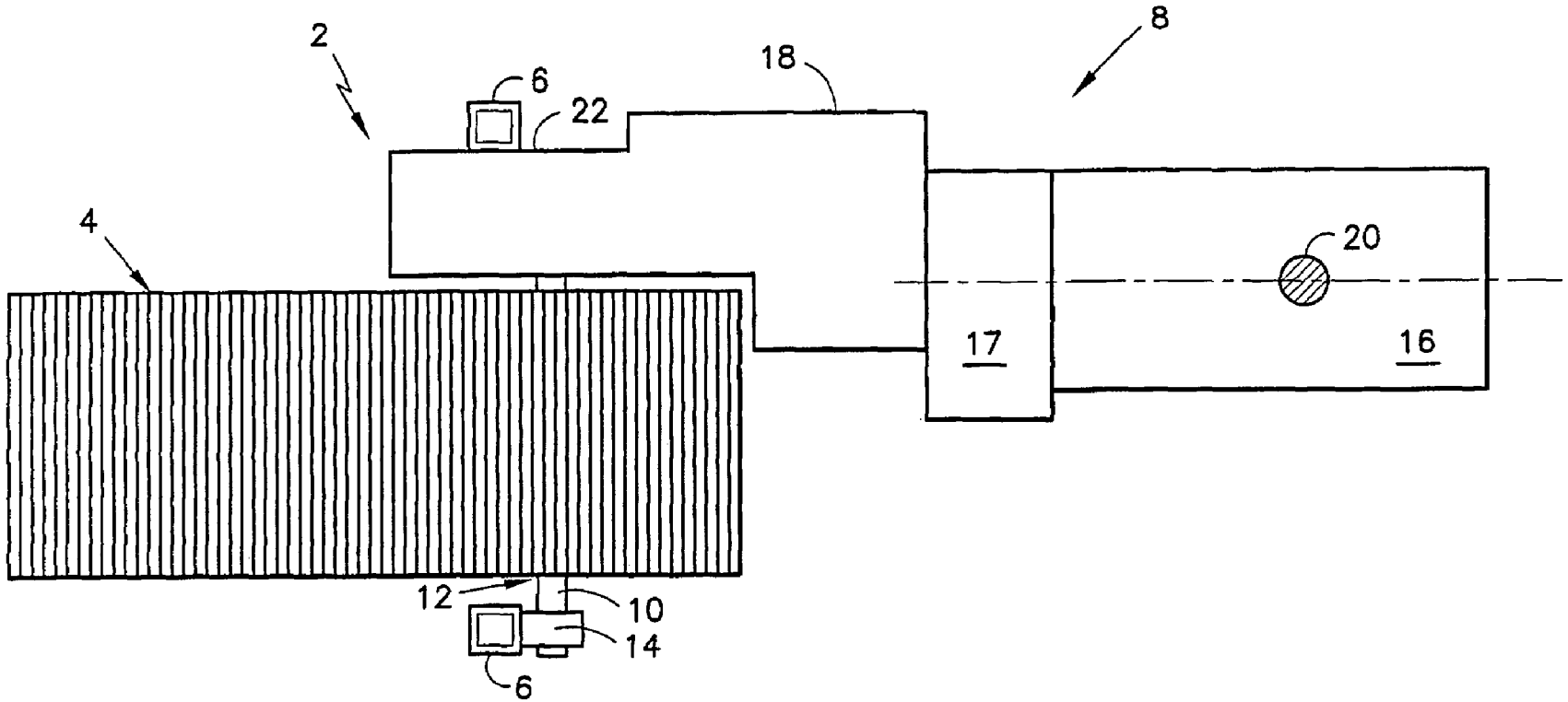
FIG. 1, the essential components of a passenger conveyor according to the present invention, and FIG. 2, a schematic representation of the drive unit used in the passenger conveyor according to the invention.

The essential components of a passenger conveyor 2 according to the invention are schematically illustrated in FIG. 1. A section of the running belt 4, parts of the frame 6, a drive unit 8, as well as the drive shaft 10 of the main running belt drive 12, are shown in this figure.

The running belt 4 may consist of a step belt if the passenger conveyor 2 consists of an escalator, with the running belt consisting of a pallet belt or an endless running belt if the passenger conveyor consists of a moving sidewalk. In any case, the running belt 4 is driven by the main running belt drive 12. The main running belt drive 12 contains at least one leveling belt driving wheel (not shown) that, for example, consists of a chain wheel that engages into a driving chain of the running belt 4. Two running belt driving wheels that are mounted on a common drive shaft 10 are usually provided, i.e., one running belt driving wheel is arranged on each side of the running belt 4.

The running belt drive shaft 10 is mounted on the frame 6 of the passenger conveyor 2 with a bearing 14 as illustrated in the lower portion of FIG. 1. Alternatively, the main running belt drive 12 may contain a separate carrying frame that is mounted on the flame 6 of the passenger conveyor 2.

The drive shaft 10 of the main running belt drive 12 is driven by a drive unit 8. The drive unit 8 contains a driving motor 16, a brake 17 and a step-down gear 18. The driving motor 16 may, for example, consist of a conventional four-pole or six-pole asynchronous motor. At a supply frequency of 50 Hz, motors of this type operate with a rotational speed of approximately 1000 to 1500 rpm. The step-down gear 18 is preferably arranged in a closed housing. The step-down gear usually provides a gear reduction ratio of approximately 120:1. Other gear reduction ratios would also be conceivable depending on the operating frequency, the driving motor and the intended use.

The driving motor 16 is mounted on the housing 22 of the step-down gear 18 by means of the brake 17. One can ascertain that the driving motor has an essentially cylindrical shape and is arranged such that its longitudinal axis essentially lies in the extension of the direction in which the step-down gear extends. Although this makes it necessary to turn the rotating direction between the driving motor 16 and the drive shaft 10 by 90, this provides the advantage that the mass distribution of the drive unit is essentially one-dimensional. This males it possible to realize a mounting of the drive unit on the main running belt drive, in which essentially no moment needs to be absorbed about the direction in which the drive unit 8 extends. One can easily ascertain that a significant moment—about the direction in which the drive unit 8 extends—would have to be absorbed within the region in which the drive wait 8 is mounted on the main running belt drive 12 if the driving motor 16 were essentially parallel to the drive axis 12. In addition, this moment would have to be transmitted by the housing of the step-down gear 18, i.e., the housing 22 would have to be realized suitably stable.

In the embodiment shown, the housing 22 of the step-down gear 18 is mounted on the frame 6 of the passenger conveyor 2. In addition, the drive unit 8 is supported with a torque support 20 by means of the driving motor 16. In an alternative construction, the drive unit 8 essentially is only supported by the drive shaft 10 of the main running belt drive 12.

FIG. 1 clearly shows that the drive unit 8 does not protrude underneath the running belt 4, but usually into the upper machine region outside the running belt 4. In contrast to an arrangement, in which the drive unit 8 is arranged between the forward running section and the backward running section of the running belt 4, this provides the advantage that, for example, the drive unit is easily accessible for being actuated manually. A manual actuation may be required if, for example, passengers within the region of the running belt need to be rescued after an emergency shut-off.

Figure 2:
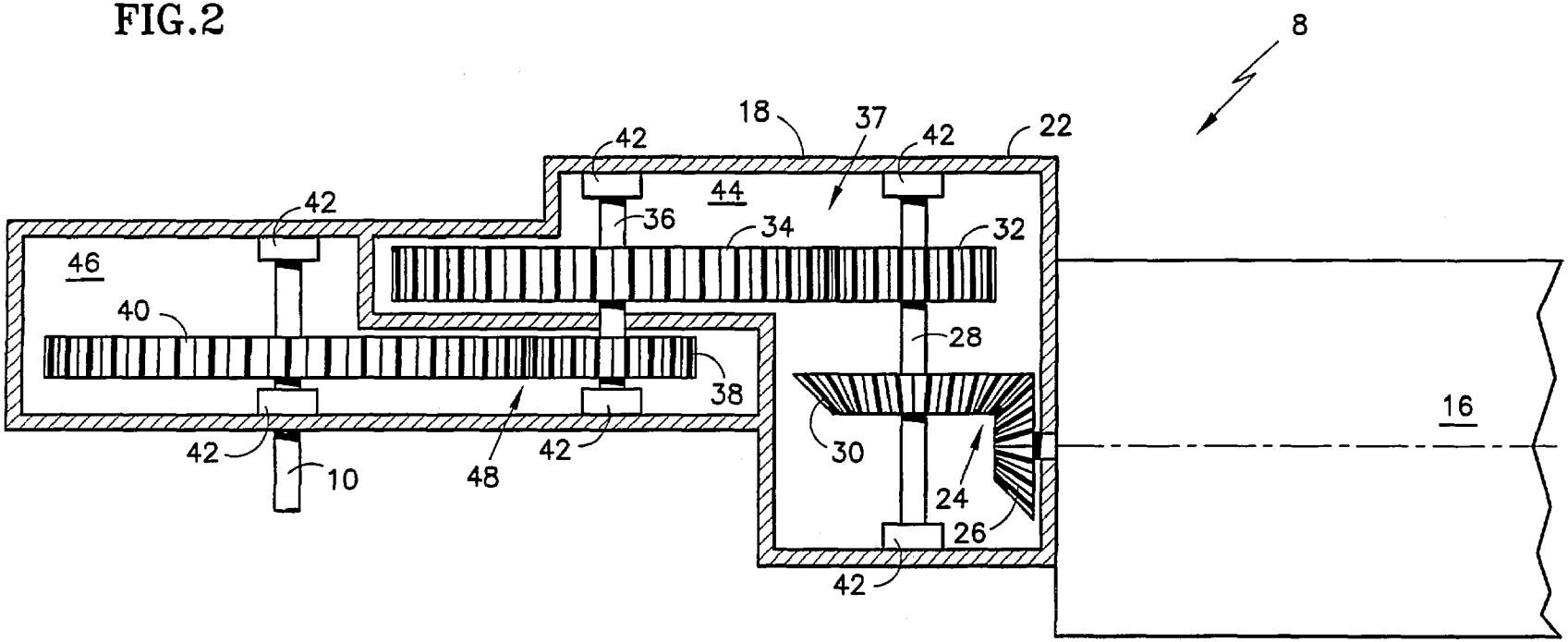

FIG. 2 essentially shows the step-down gear 18 of the drive unit 8 in the form of an enlarged representation. The driving motor 16, the longitudinal axis of which is turned relative to the rotational axes of the individual toothed wheels in the step-down gear 18 by 90, is also shown in this figure. A conical gear 24 is arranged in a housing 22 of the step-down gear, with said conical gear forming the first stage of the step-down gear and containing a first conical gear wheel 26 and a second conical gear wheel 30 that is mounted on the gear shaft 28. A smaller spur wheel 32 that is engaged with a larger spur wheel 34 rotates together with the second conical gear wheel 30 and the gear shaft 28. The spur wheel 34 is fixed on a shaft 36. The two spur wheels 32 and 34 form the second gear reduction stage 38. Another small spur wheel 38 that is engaged with another larger spur wheel 40 which ultimately drives the drive shaft 10 at the desired rotational speed rotates with the spur wheel 34 and the shaft 36. The individual gear shafts are arranged in the housing 22 of the step-down gear in corresponding bearings 42 that are schematically illustrated in this figure.

The step-down gear is divided into two chambers 44 and 46, with the first gear reduction stage 24 and the second gear reduction stage 38 being arranged in the first chamber 44, and with the third gear reduction stage 48 which is formed by the spur wheels 38 and 40 being arranged in the second chamber 46. This makes it possible to provide separate lubrication for each of the two chambers 44, 46. In addition, this allows a particularly simple modular design of the drive unit 8 such that several modules consisting of a driving motor 16 and a first and a second stage 24 and 38 of the step-down gear can be connected to the last toothed wheel 40 of the gear train depending on the power requirement of the drive unit 8. In extreme instances, several modules can be arranged around the last toothed wheel 40 of the gear train similar to a radial engine. The housing in which the last toothed wheel 40 of the gear train is accommodated, may, for example, be provided with several openings, to which the individual modules can be connected. However, these openings need to be sealed if no module is connected to the respective opening.

The driving power can also be increased by connecting one respective drive unit 8 to both sides of the drive shaft 10 in a passenger conveyor 2.

It would also be relatively simple to realize different gear reduction ratios for different applications and different driving motors 16 by changing the toothed wheels in the step-down gear 18. In addition, the drive unit 8 may, for example, contain the essential components of the main running belt drive 12. For example, the bearing arrangement for the drive shaft 10 may be integrated into the drive unit 8. It would also be conceivable to realize the main running belt drive integrally with the drive unit 8, in particular, if the last toothed wheel 40 is realized integrally with the running belt driving wheel.

It should also be mentioned that the hand rail drive (not shown) may be driven by the last toothed wheel 40 of the toothed wheel train or by the running belt driving wheel. Alternatively, a pick-off wheel for the hand rail drive may, for example, be connected to the last toothed wheel 40 and/or the running belt driving wheel.

What is claimed is:

1. A passenger conveyor with a running belt, comprising:

(a) a frame, (b) a main running belt drive that is mounted on the frame and contains a drive shaft and at least one running belt driving wheel that is connected to the drive shaft, and (c) a drive unit for driving the main running belt drive, with the drive unit containing a driving motor and a step-down gear, and with the output of the step-down gear being connected to the input of the main running belt drive, wherein the driving motor is mounted on a housing of the step-down gear, with the driving motor and the step-down gear forming a drive unit, and the drive unit is supported by the main running belt drive, and wherein the rotary directions of the driving motor and the drive shaft are substantially perpendicular to one another.

2. The passenger conveyor according to claim 1, characterized by the fact that the drive unit is supported by the drive shaft of the main running belt drive.

3. The passenger conveyor according to claim 1, characterized by the fact that an elastic torque support is provided between the frame and the drive unit.

4. The passenger conveyor according to claim 1, characterized by the fact that the step-down gear consists of a toothed wheel gear.

5. The passenger conveyor according to claim 4, characterized by the fact that the step-down gear consists of a step-down gear with three stages.

6. The passenger conveyor according to claim 5, characterized by the fact that the first stage of the step-down gear consists of a conical gear that serves for turning the axis of rotation by 90°, and by the fact that the second stage and the third stage of the step-down gear consist of spur gears, in which the direction of the axis of rotation remains unchanged.

7. The passenger conveyor according to claim 6, characterized by the fact that the housing of the step-down gear is divided into different chambers in order to allow the use of different lubricants for the different gear stages.

8. The passenger conveyor according to claim 7, characterized by the fact that a first chamber is provided for the first gear stage and the second gear stage, and by the fact that a second chamber is provided for the third stage.

9. The passenger conveyor according to claim 1, characterized by the fact that individual modules which respectively contain first stages of the step-down gear and the driving motor can be connected to a last toothed wheel of a gear train, from which the output of the step-down gear takes place.

10. The passenger conveyor according to claim 1, characterized the fact that the output of the step-down gear is connected to the drive shaft of the main running belt drive.

11. The passenger conveyor according to claim 9, characterized by the fact that the last toothed wheel of the gear train is directly connected to the running belt driving wheel of the main running belt drive.

12. A drive unit for a passenger conveyor with a running belt, wherein the passenger conveyor includes a frame and a main running belt drive that is mounted on the frame and contains a drive shaft said drive unit comprising:

a driving motor; and a step-down gear that is connected to the main running belt drive, wherein the driving motor is mounted on a housing of the step-down gear, and the drive unit is supported by the main running belt drive, wherein the rotary directions of the driving motor and the drive shaft are substantially perpendicular to one another.

13. A passenger conveyor with a running belt, comprising:

(a) a frame, (b) a main running belt drive that is mounted on the frame and contains a drive shaft and at least one running belt driving wheel that is connected to the drive shaft, and (c) a drive unit for driving the main running belt drive, with the drive unit containing a diving motor and a step-down gear, and with the output of the step-down gear being connected to the input of the main running belt drive, wherein the driving motor is mounted on the housing of the step-down gear, with the driving motor and the step-down gear forming a drive unit, and by the fact that the drive unit is supported by the main running belt drive, wherein the drive unit is arranged outside of a space defined by forward and backward running sections of the running belt.

14. A drive unit for a passenger conveyor with a running belt, wherein the passenger conveyor includes a frame and a main running belt drive that is mounted on the frame and contains a drive shaft, said drive unit comprising:

a driving motor; and a step-down gear that is connected to the main running belt drive, wherein the driving motor is mounted on a housing of the step-down gear, and the drive unit is supported by the main running belt drive, wherein the drive unit is arranged outside of a space defined by forward and backward running sections of the running belt.

15. The passenger conveyor according to claim 13, characterized by the fact that the drive unit is supported by the drive shaft of the main running belt drive.

16. The passenger conveyor according to claim 13, characterized by the fact that an elastic torque support is provided between the frame and the drive unit.

17. The passenger conveyor according to claim 13, characterized by the fact that the step-down gear consists of a toothed wheel gear.

18. The passenger conveyor according to claim 17, characterized by the fact that the step-down gear consists of a step-down gear with three stages.

19. The passenger conveyor according to claim 18, characterized by the fact that the first stage of the step-down gear consists of a conical gear that serves or turning the axis of rotation by 90°, and by the fact that the second stage and the third stage of the step-down gear consist of spur gears, in which the direction of the axis of rotation remains unchanged.

20. The passenger conveyor according to claim 19, characterized by the fact that the housing of the step-down gear is divided into different chambers in or ler to allow the use of different lubricants for the different gear stages.

21. The passenger conveyor according to claim 20, characterized by the fact that a first chamber is provided for the first gear stage and the second gear stage and by the fact that a second chamber is provided for the third stage.

22. The passenger conveyor according to claim 13, characterized by the fact that individual modules which respectively contain the first stages of the step-down gear and a driving motor can be connected to a last toothed wheel of a gear train, from which the output of the step-down gear takes place.

23. The passenger conveyor according to claim 13, characterized the fact that the output of the step-down gear is connected to the drive shaft of the main running belt drive.

24. The passenger conveyor according to claim 22, characterized by the fact that the last toothed wheel of the gear train is directly connected to the running belt driving wheel of the main running belt drive.

* * * * *